US005200780A

United States Patent [19]

Koichi

[11] Patent Number: 5,200,780

[45] Date of Patent: Apr. 6, 1993

[54] ADJUSTMENT OF SURFACE POTENTIAL SENSOR RESPONSIVE TO PHOTOCONDUCTIVE ELEMENT OF IMAGE FORMING APPARATUS

[75] Inventor: Tasushi Koichi, Yamato, Japan

[73] Assignee: Ricoh Company, Ltd., Tokyo, Japan

[21] Appl. No.: 831,196

[22] Filed: Jan. 31, 1992

[30] Foreign Application Priority Data

Jan. 31, 1991 [JP] Japan ..... 3-32160
Dec. 16, 1991 [JP] Japan ..... 3-332246

[51] Int. Cl.[5] ..... G03G 15/00

[52] U.S. Cl. ..... 355/208; 324/452; 361/230; 355/210; 355/219; 355/246

[58] Field of Search ..... 355/219, 208, 221, 225, 355/222, 223, 246, 203, 204, 210; 361/230, 235; 324/452, 453, 454, 455

[56] References Cited

U.S. PATENT DOCUMENTS 3,998,538 12/1976 Urso et al. ..... 324/455 X
4,127,806 11/1978 Shuey et al. ..... 324/452
4,474,455 10/1984 Hirakura et al. ..... 355/77 X
4,591,262 5/1986 Oseto et al. ..... 355/219 X
4,797,707 1/1989 Iwahashi et al. ..... 355/221 X
4,970,557 11/1990 Masuda et al. ..... 355/246

*Primary Examiner*—A. T. Grimley
*Assistant Examiner*—T. A. Dang
*Attorney, Agent, or Firm*—Oblon, Spivak, McClelland, Maier & Neustadt

[57] ABSTRACT

A method of adjusting a surface potential sensor for measuring the surface potential of a photoconductive element, or image carrier, included in an electrophotographic image forming apparatus. The method uses the substrate of the photoconductive element as a reference plate in the event of adjustment. Before the photoconductive element is used as a reference plate, the element is left unused for a period of time long enough for the element to recover from fatigue. Then, a reference voltage is applied to the substrate, and the resulting potential of the surface of the photoconductive element is used as a reference value for adjustment.

11 Claims, 18 Drawing Sheets

START
START TIMER
FIX TEMP. LOWER THAN 100°C ?
NO
YES
SET UP SENSOR ADJUST MODE
SET UP IMAGE FORM MODE
INHIBIT ROTATION OF BELT
INHIBIT IMAGE FORMATION
4 MIN. ELAPSED AFTER START OF TIMER ?
NO
YES
SENSOR ADJUSTMENT
OPEN NORMALLY CLOSED CONTACT
CLEAR TIMER
CANCEL INHIBITION OF BELT ROTATION
CANCEL INHIBITION OF IMAGE FORMATION
RETURN

ADJUSTMENT OF SURFACE POTENTIAL SENSOR RESPONSIVE TO PHOTOCONDUCTIVE ELEMENT OF IMAGE FORMING APPARATUS

BACKGROUND OF THE INVENTION

The present invention relates to a method of adjusting a surface potential sensor for measuring the surface potential of a photoconductive element, or image carrier, included in an electrophotographic image forming apparatus.

Generally, a laser printer, electrophotographic copier, facsimile transceiver or similar electrophotographic image forming apparatus has an image carrier in the form of a photoconductive drum or a photoconductive belt. In this kind of apparatus, a charger uniformly charges the surface of the photoconductive drum or belt to a predetermined potential, and then an exposing device electrostatically forms a latent image on the charged surface by illuminating it imagewise. A developing device develops the latent image by a toner. The resulting toner image is transferred to a paper sheet fed from a paper feeding section included in the apparatus. A surface potential sensor may be located to face the photoconductive element for measuring the surface potential of the element, as disclosed in, for example, Japanese Patent Laid-Open Publication Nos. 95255/1981 and 83743/1988. In such a case, the voltages to be applied to, among others, the charger and developing roller are controlled to optimal values on the basis of the surface potential of the drum or belt measured by the surface potential sensor, thereby stabilizing the image quality. A volume for adjustment is usually associated with the surface potential sensor and operable to adjust the sensor in matching relation to the varying degree of deterioration thereof, i.e., the frequency of use. Such adjustment is extremely troublesome and usually performed by a serviceman. However, the surface potential sensor cannot be provided with high accuracy since the adjustment relies on manual work, i.e., differs from one serviceman to another. While a highly accurate and reliable surface potential sensor may be incorporated in the image forming apparatus, it increases the overall cost of the apparatus and, therefore, cannot be applied to inexpensive apparatuses.

In light of the above, a reference plate in the form of an electrode may be located to face the measuring surface of the surface potential sensor in order to adjust the sensor automatically, as also taught in Japanese Patent Laid-Open Publication No. 95255. Such an implementation has a problem that the reference plate or electrode increases the cost of the apparatus. Another problem is the potential which is not necessary for image formation and remains on the surface of the photoconductive element due to aging and changes in ambient conditions. Specifically, even if the surface potential of the photoconductive element is measured with accuracy, some special means has to be provided for cancelling the potential remaining on the photoconductive element, complicating the construction and control of the apparatus.

To reduce the cost of the apparatus, use may be made of a relatively inexpensive surface potential sensor which has distance dependency. However, such a sensor cannot be used unless the distance between the sensor and the reference plate or electrode is the same as or substantially same as the distance between the sensor and the photoconductive element, again resulting in a complicated construction.

SUMMARY OF THE INVENTION

It is, therefore, an object of the present invention to provide a method of adjusting a surface potential sensor capable of detecting the surface potential of a photoconductive element accurately without resorting to extra cost or complicated construction and with no regard to the potential remaining on the photoconductive element.

A method of adjusting a surface potential sensor for measuring the surface potential of a photoconductive element included in an image forming apparatus of the present invention comprises leaving the photoconductive element unused for a period of time necessary for the element to recover from fatigue, applying a reference voltage to a substrate included in the photoconductive element, and adjusting the surface potential sensor by using the resulting potential of the surface of the photoconductive element as a reference value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
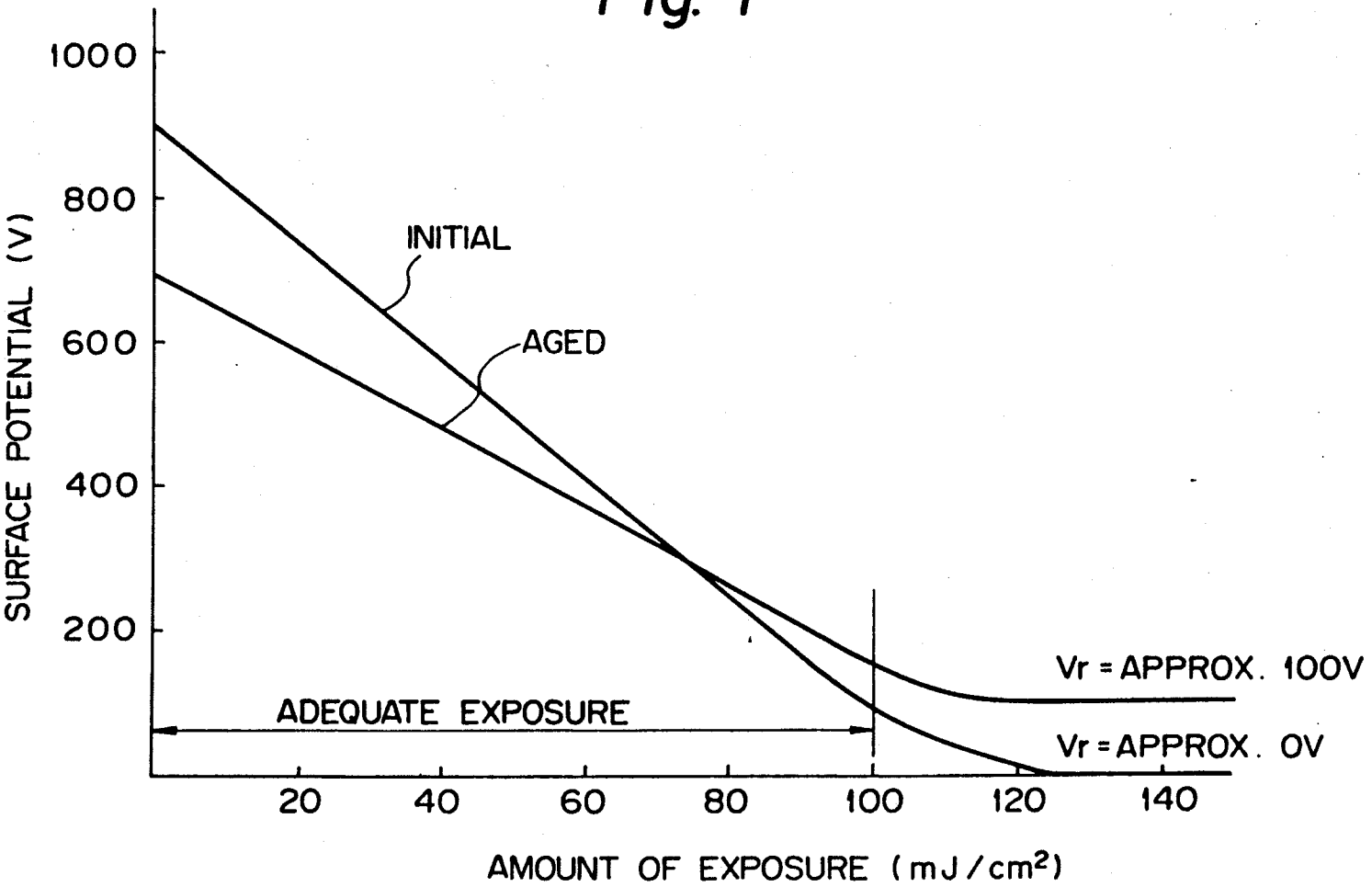
FIG. 1 is a graph showing a relation between the amount of exposure and the surface potential of a photoconductive element.
Figure 2:
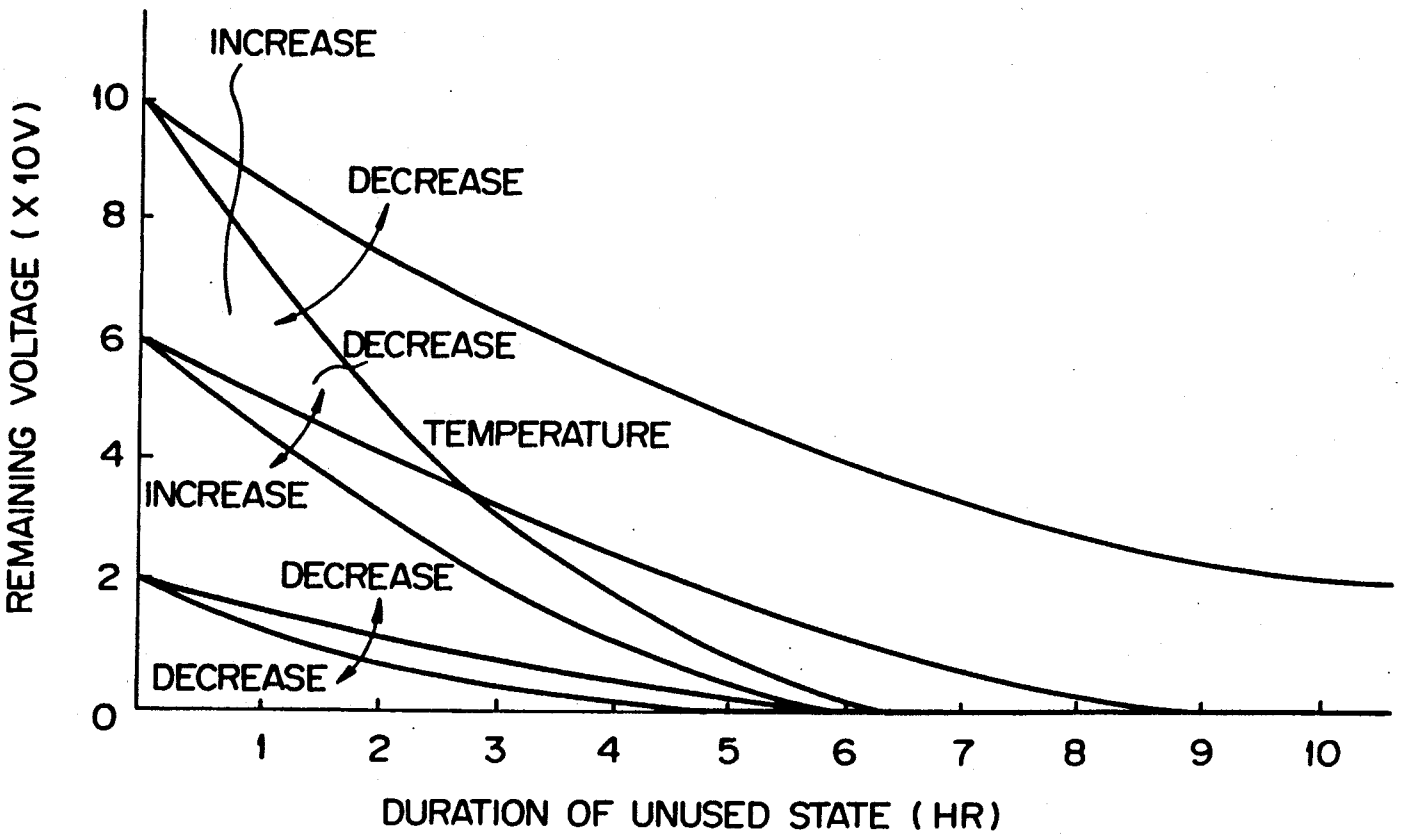
FIG. 2 is a graph showing a relation between the duration of the unused state of a photoconductive element and the remaining potential.

FIG. 1 of the drawings shows a relation between the amount of exposure and the surface potential of a photoconductive element. As shown, a photoconductive element for an image forming apparatus has such a characteristic that the charge potential sequentially decreases due to aging while the remaining potential Vr sequentially increases. A photoconductive element, therefore, cannot be used as a reference plate for adjusting a surface potential sensor unless the above problem is eliminated. FIG. 2 indicates a relation between the period of time for which a photoconductive element is left unused and the remaining potential, although this relation depends on the degree of fatigue of the element. As shown, the higher the remaining potential, the longer the time necessary for the element to recover is. The photoconductive element cannot be used until such a period of time elapses. Further, the higher the temperature when a photoconductive element is left unused, the faster the element recovers; at temperatures above a certain temperature, the recovering time does not change with relative to the level of the remaining potential. Experiments showed that the certain temperature mentioned above is related to the temperature at which a photoconductive element fatigues due to a charge, illumination and similar hazards during image formation; the degree of fatigue increases with a decrease in temperature and with a increase in time (aging). It was found that when the temperature of a photoconductive element left unused is controlled to the highest temperature acted on the element during image formation, the period of time necessary for the element to recover remains substantially constant with no regard to the degree of fatigue, although why this occurs is not clear at the present stage of study.

Figure 3:
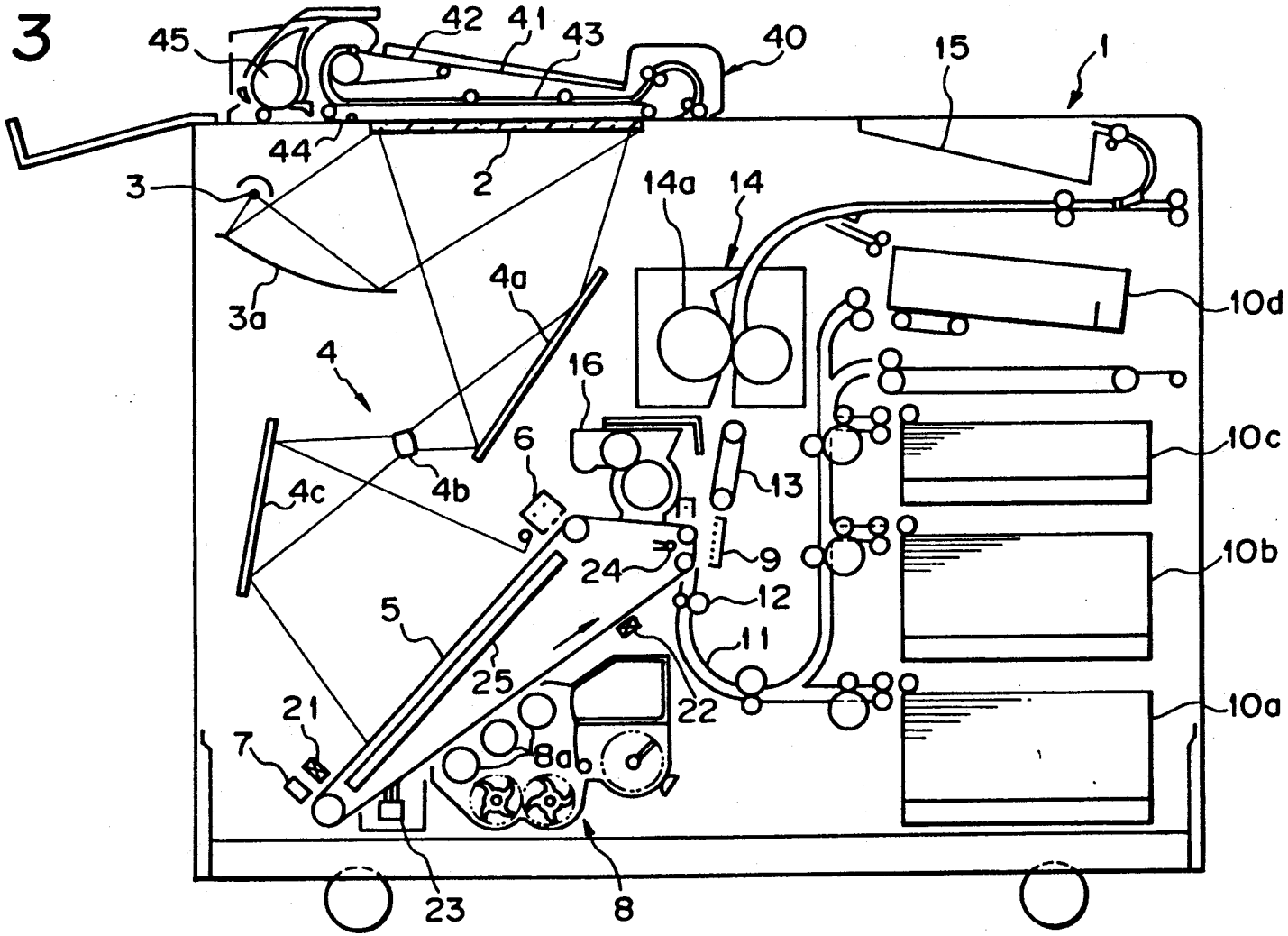
FIG. 3 is a section showing a copier with which an embodiment of the present invention is practicable.
Figure 4:
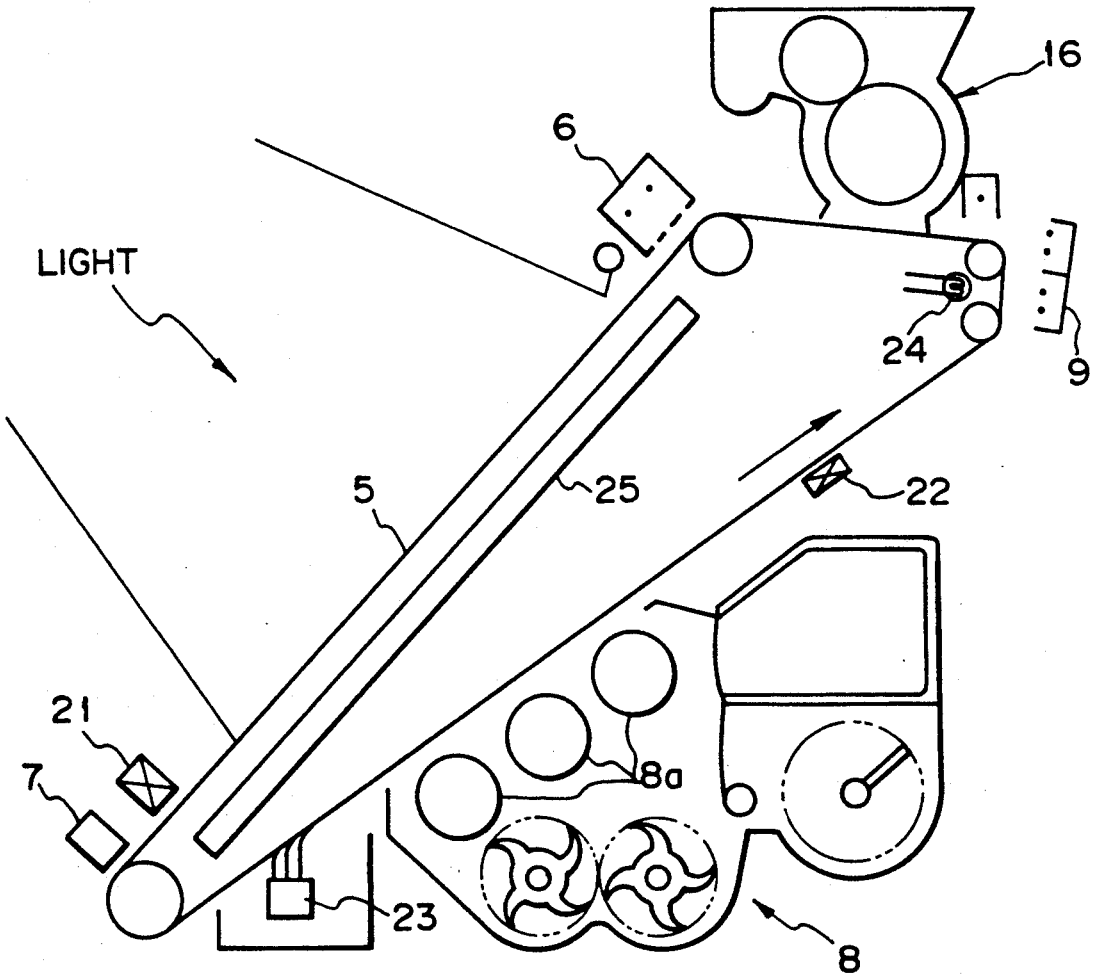
FIG. 4 is a fragmentary enlarged view of the copier.

Referring to FIGS. 3 and 4, a copier to which a preferred embodiment of the present invention is applied is shown. As shown, the copier is generally made up of a copier body 1 and a recycling document feeder or handler (RDH) 40. The copier starts a copying operation when the operator presses a copy start key after entering necessary copying conditions on an operation panel, not shown, provided on the copier 1. The RDH 40 has a tray 41 on which a stack of documents are laid face down. A belt 42 transports the documents one by one from the tray 41 to a glass platen 2 via a transport path 43. As the document is positioned on the glass platen 2, a lamp 3 emits light. The light is reflected by a mirror 3*a* to illuminate the image surface of document over a predetermined period of time. The resulting reflection from the document is incident to a photoconductive belt 5 via a first mirror 4*a*, a through lens 4*b* and a second mirror 4*c* which constitute optics 4.

The surface of the photoconductive belt 5 is uniformly charged by a main charger 6 beforehand. As a result, the reflection from the document electrostatically forms a latent image on the belt 5. After an eraser 7 has removed the charge from unnecessary portions of the belt 5, a developing roller 8*a* included in a developing unit 8 develops the latent image by a toner to produce a toner image. A paper sheet is fed from any one of paper trays 10*a*, 10*b* and 10*c* to a register roller 12 over a transport path 11 and then driven to an image transfer station in synchronism with the toner image, whereby the toner image is transferred from the belt 5 to the paper sheet. The paper sheet carrying the toner image thereon is further transported to a fixing unit 14 by the belt 13. The fixing unit 14 fixes the toner image on the paper sheet by a heat roller 14*a*. Subsequently, the paper sheet is driven out to a copy tray 15 or steered by a selector or pawl, not shown, toward an intermediate or two-side tray 10*d*. When paper sheets each carrying an image on one side thereof are stacked on the intermediate tray 10*d*, they are refed at a predetermined timing and again transported to the image transfer station in a reversed position. Then, the above-stated copying process is effected with the other side of the paper sheets. The document having undergone illumination is driven out of the glass platen 2 by a transport belt 44 and then returned to the tray 41 by a discharge roller 45. A cleaning unit 16 removes the charge and toner remaining on the photoconductive belt 5 after the image transfer, and then the main charger 6 again charges the belt 5 to prepare it for another exposure.

Figure 5:
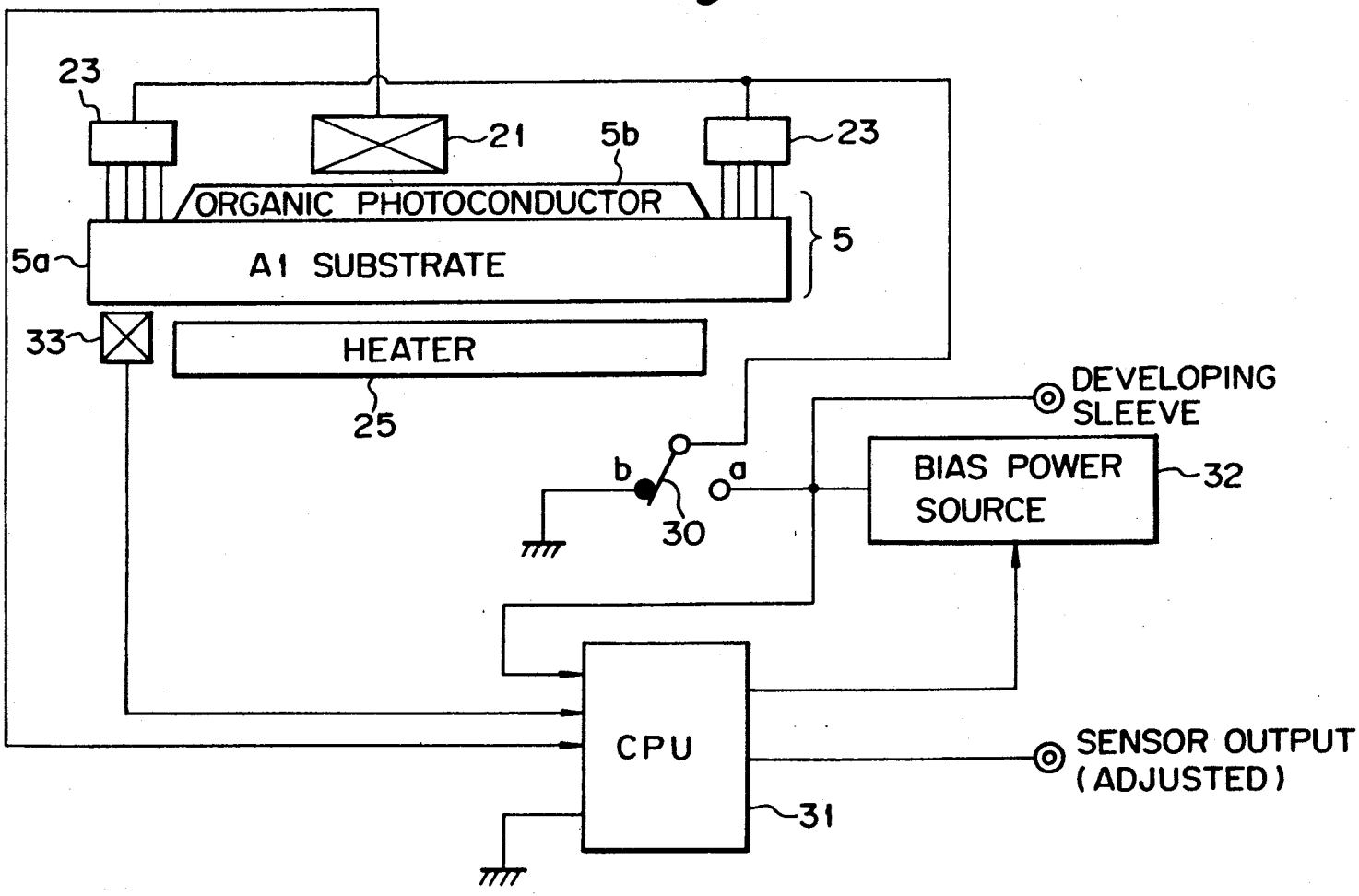
FIG. 5 is a block diagram schematically showing part of a control section included in the copier which is relevant to the embodiment.

As shown in FIG. 5, the photoconductive belt 5 is constituted by a substrate 5*a* made of aluminum and a laminate organic photoconductor 5*b* provided on the substrate 5*a*.

As shown in FIG. 3, a surface potential sensor 21 is fixed in place with the sensing surface thereof facing the photoconductive belt 5. The output of the surface potential sensor 21 is used to control the voltages to be applied to the main charger 6 and developing roller 8*a* to optimal values. The sensor 21 is implemented by an inexpensive sensor whose output changes with the distance or gap between it and the surface of the belt 5, i.e., a distance dependent sensor. The gap is selected to be about 4 millimeters to facilitate the mounting and dismounting of the belt 5. A density sensor (sometimes referred to as a P sensor hereinfter) 22 is constituted by, for example, a photosensor and located to face the belt 5. The density sensor 22 senses the density of a toner image representative of a reference pattern and formed on an area of the belt 5 outside of an image area and the density of the background of the belt 5 by illuminating them and receiving the resulting reflections. The output of the density sensor 22 is sent to a control section incorporated in the copier. The control section controls a bias voltage for development in matching relation to the ratio of the sensed densities, thereby maintaining the image density adequate. As also shown in FIG. 5, a brush 23 is held in contact with the Al (aluminum) substrate 5*a* of the belt 5. The brush 23 selectively connects the Al substrate 5*a* to ground or applies a reference voltage for adjustment to the surface potential sensor 21 by a switch which will be described. A pretransfer lamp (PTL) 24 illuminates the belt 5 from the back to dissipate the surface potential of the belt 5. A heater 25 heats the belt 5 from the back while the power supply to the copier is shut off, thereby causing the belt 5 to recover from fatigue rapidly.

FIG. 5 shows only part of the control system which pertains to the illustrative embodiment. The Al substrate 5 of the photoconductive belt 5 is usually connected to ground via the casing of the copier by a relay switch, or simply switch, 30. A microcomputer (referred to as a CPU hereinafter) 31 has a microprocessor, ROM (Read Only Memory), RAM (Random Access Memory), timer, counter, I/O (Input and Output) interface, etc. During a copy mode operation, the CPU 31 determines the actual surface potential of the belt 5 and feeds it back to a bias power source 32 to thereby apply an optimal bias voltage for development to the developing roller or sleeve 8*a*, as will be described later specifically. The bias power source 32 additionally serves as a drive source for the surface potential sensor 21 and a reference power source in the event of adjustment of the sensor 21. The voltage to be applied to the main charger 6, FIGS. 3 and 4, is also controlled to an optimal value on the basis of the measured surface potential, although not shown in the figure. A thermistor 33 is located in the vicinity of the belt 5 to constantly sense the temperature of the belt 5. The CPU 31 stores the highest temperature of the belt 5 sensed by the thermistor 33 in the RAM thereof. Even when a main switch, not shown, is operated to shut off the power supply to the copier, the highest temperature is held in the RAM by a back-up power source. Subsequently, as soon as the power supply to the copier is turned off, the heater 25 is turned on while a timer, not shown, is started to count the time for which the belt 5 is left unused. The timer is used to determine whether or not the belt 5 has been left unused up to the time when it recovers from fatigue to allow the surface potential sensor 21 to be adjusted.

As shown in FIG. 2, the photoconductive belt 5 becomes ready to serve as a reference plate for the adjustment of the surface potential sensor 21 when left unused for about 6 hours. However, in the illustrative embodiment, the period of time is selected to be about 10 hours (approximately one night) in consideration of the fluctuation of the control over the temperature of the belt 5 and the actual frequency of use. When the power supply to the copier is turned off and the heater 25 is turned on, the CPU 31 controls the temperature of the belt 5 in such a manner as to maintain the highest temperatue level by using the thermistor 33. On the turn-on of the power supply to the copier, the CPU 31 determines whether or not more than 10 hours has elapsed after the turn-off of the power supply. If more than 10 hours has elapsed, the CPU 31 starts on a sensor adjust mode, i.e., adjusts the output potential level of the surface potential sensor 21 to the initial value on the elapse of 4 minutes including the stabilizing time of the bias power source 32. The initial value is set at the time of shipment of the apparatus and assumed to be zero volts herein. Subsequently, a relay, not shown, is operated to open the normally closed contact b of the relay switch 30 while closing the normally open contact a. As a result, the Al substrate 5a of the belt 5 is connected to the output of the bias power source 32 and thereby applied with a reference voltage. This reference voltage may be suitably selected on the basis of the accuracy and stability of the surface potential sensor 21. At this instant, the output voltage level of the sensor 21 is adjusted to the same value as the reference voltage (here, −1000 V).

To adjust the surface potential sensor 21 means to adjust the output thereof to, for example, zero volts and store it in a RAM. The content of the RAM is held up to the time when the sensor 21 should be adjusted again.

After the adjustment, the normally closed contact b of the relay switch 30 is closed to connect the Al substrate 5a to ground. This is the end of the sensor adjust mode operation. Thereafter, the heater 25 is turned off, the highest temperature having been stored is cleared, and the timer is cleared, i.e., stops counting the time for which the belt 5 has been left unused.

Figure 6A:
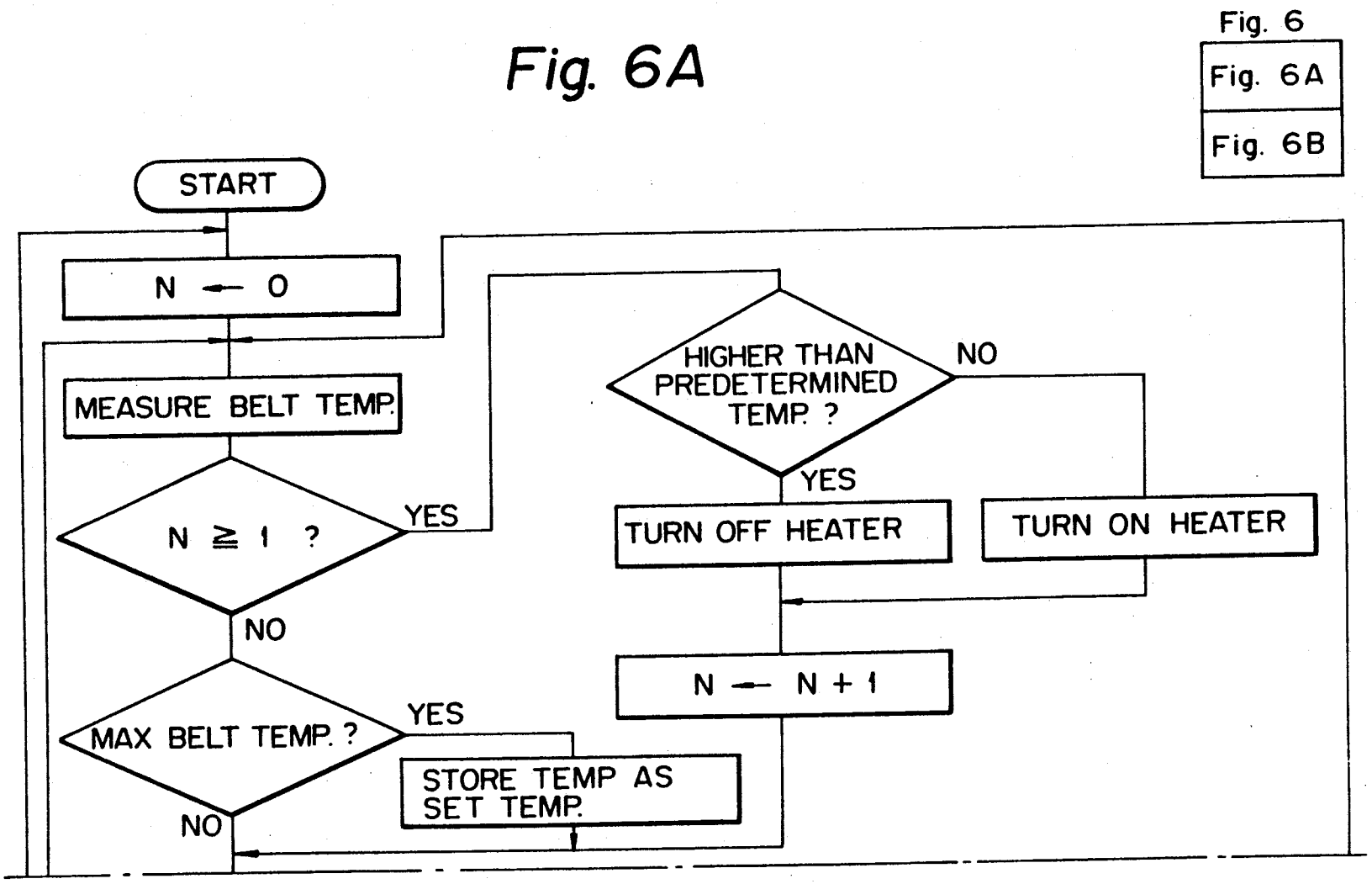
FIG. 6 is a flowchart demonstrating a specific operation of a CPU (Central Processing Unit) included in the control section of FIG. 5.
Figure 6B:
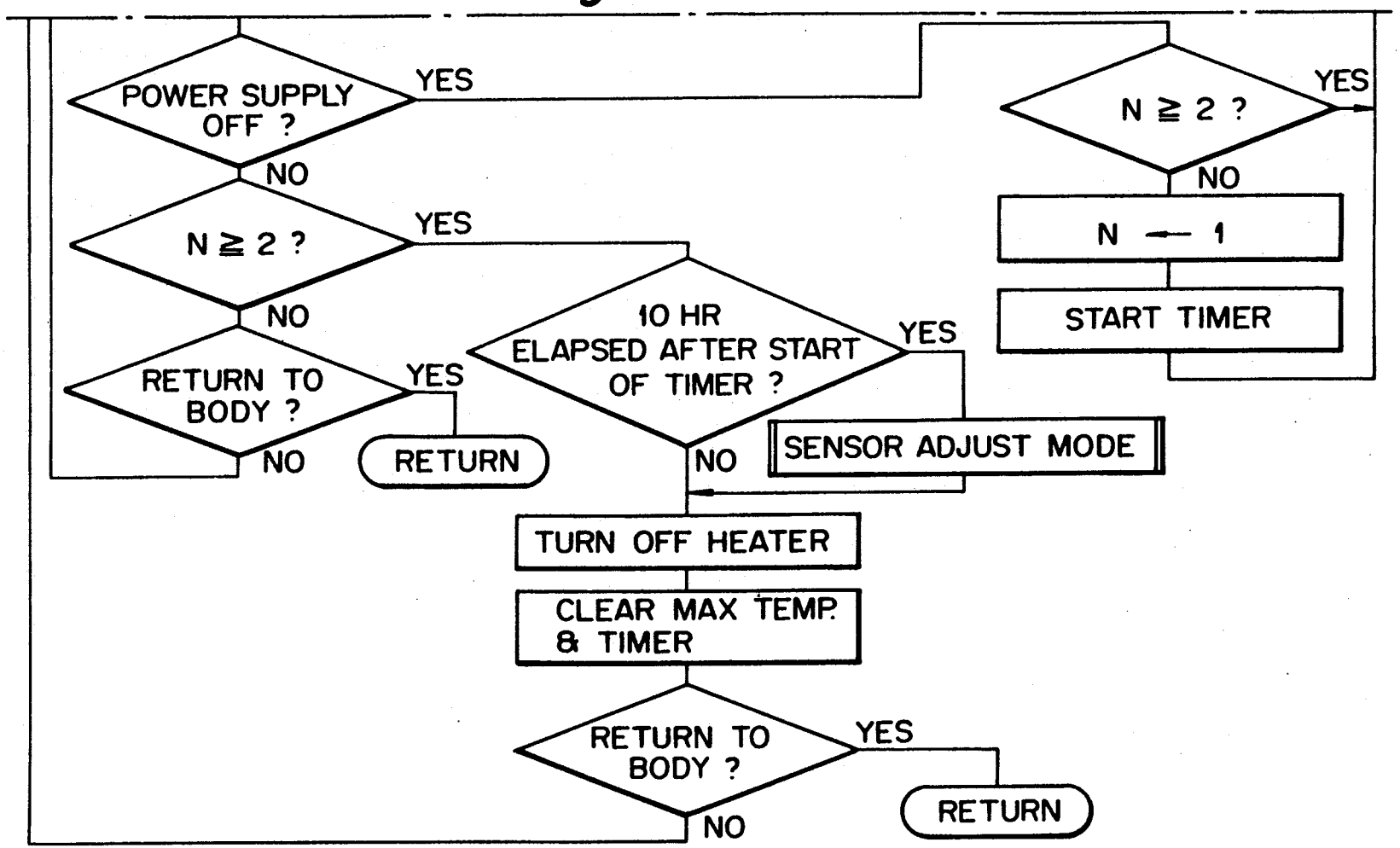

The above-described procedure for adjusting the surface potential sensor 21 is demonstrated in detail in FIG. 6. In FIG. 6, N is representative of the count of the counter built in the CPU 31.

As stated above, after the belt 5 has been left unused over a period of time long enough for the belt 5 to recover from fatigue, a reference voltage is applied to the Al substrate 5a of the belt 5. The surface potential sensor 21 is adjusted on the basis of the resulting surface potential of the belt 5. This is successful in promoting accurate detection of the surface potential of the belt 5 and, therefore, in insuring stable image quality. Since the embodiment measures the change in the remaining potential Vr during copying as well, it is possible to apply a bias voltage for development matching the remaining potential Vr to thereby further facilitate the stabilization of an image. The belt 5 out of operation is held at the highest temperature having been measured during copying so as to maintain the recovery time of the belt 5 constant. The recovery time is, therefore, fixed to simplify the processing.

Figure 7:
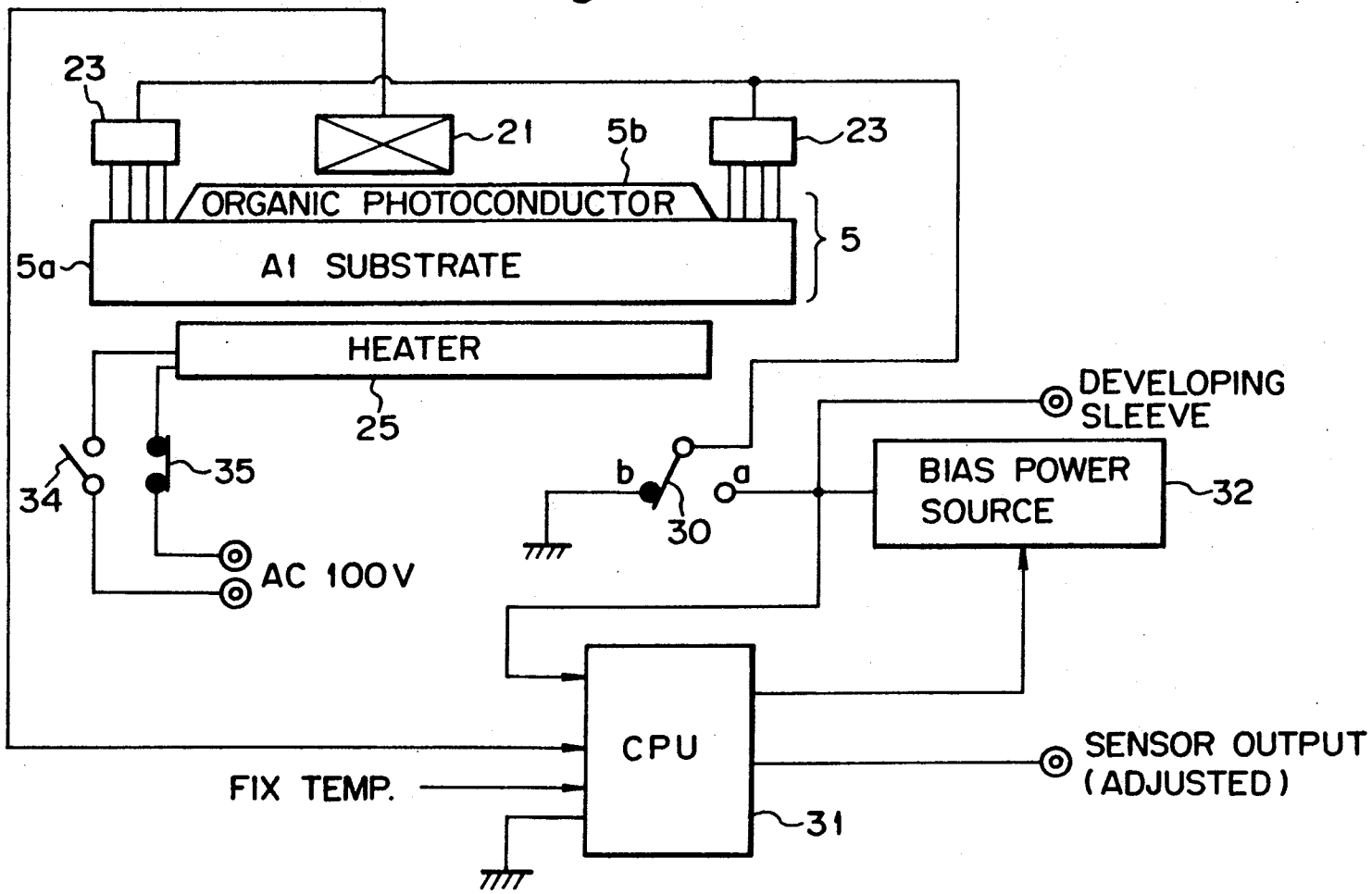
FIG. 7 is a block diagram schematically showing part of a control section representative of an alternative embodiment of the present invention.

Referring to FIG. 7, part of a control system representative of an alternative embodiment of the present invention is shown. In FIG. 7, the same parts and elements as those shown in FIG. 5 are designated by the same reference numerals, and redundant description will be avoided for simplicity. In this embodiment, the temperature of the heater 25 is controlled by a thermostat. Specifically, a heater power source (AC 100 V) is continuously turned on even when the main switch of the copier is turned off, maintaining the normally closed contact 35 of a relay switch, not shown, closed. Hence, when the heater temperature is low, a thermoswitch 34 included in the thermostat remains closed feeding a current to the heater 25. As the heater temperature elevates beyond a predetermined temperature (highest temperature of the belt 5 occurred during image formation), the thermoswitch 34 is opened to turn off the heater 25.

Figure 8:
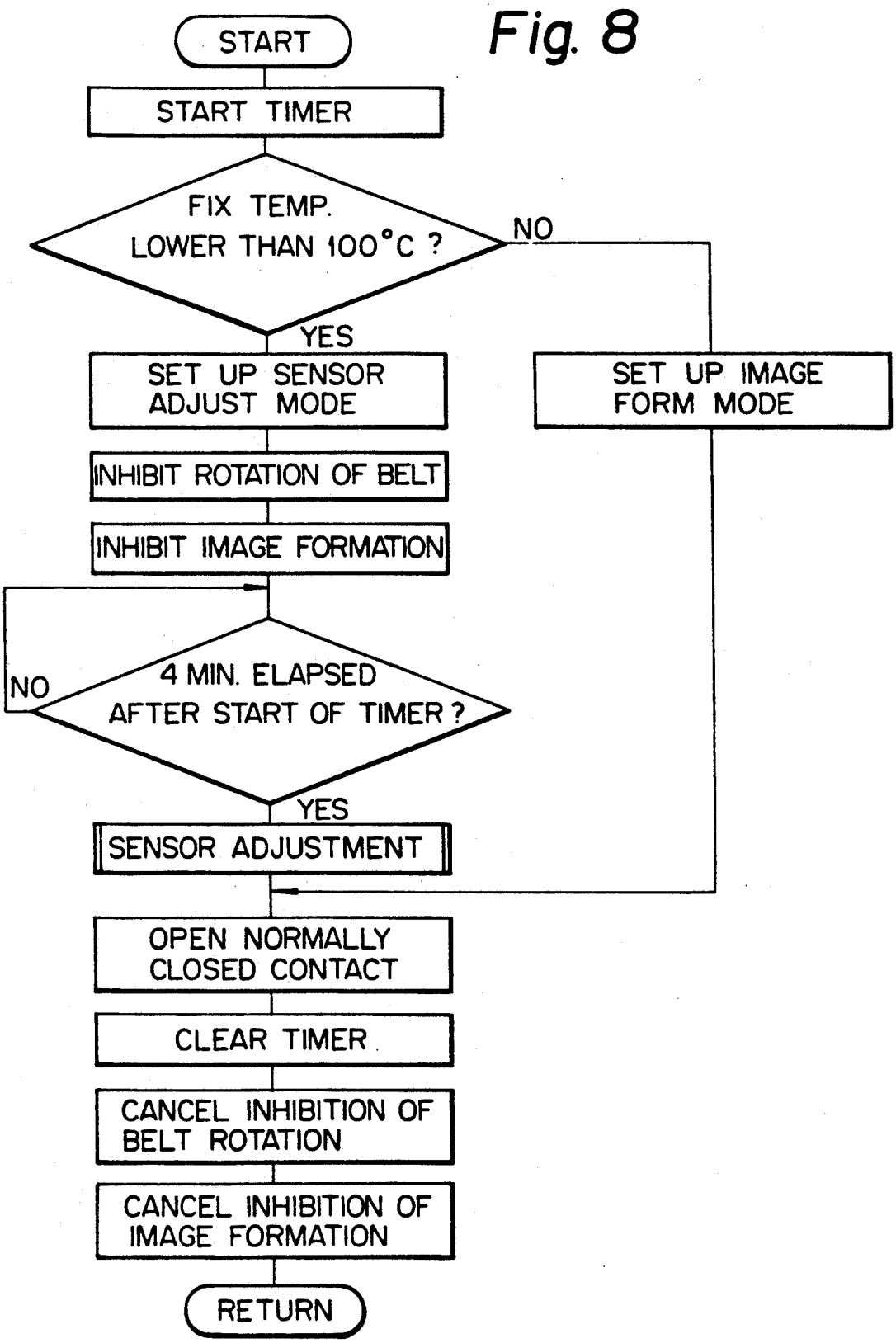
FIG. 8 is a flowchart indicative of a specific operation of a CPU included in the control section of FIG. 7.
Figure 9:
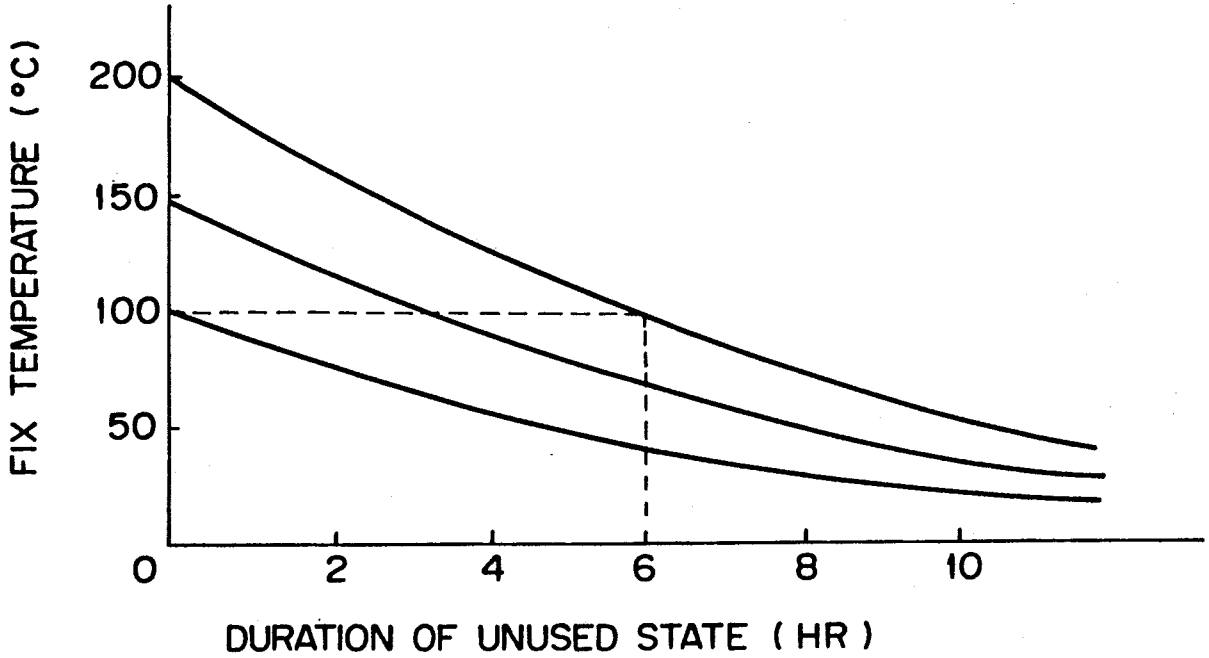
FIG. 9 is a graph showing a relation between the duration of the unused state of a photoconductive element and the fixing temperature.

FIG. 8 demonstrates a routine which the CPU 31 executes to adjust the surface potential sensor 21 in this embodiment. This routine is called from a main routine, not shown, when the power supply to the copier is turned on. As shown, the CPU 31 determines whether or not the temperature of the fixing unit 14, i.e., fixing temperature is lower than 100° C. Specifically, the CPU 31 measures the surface temperature of the fixing roller 14a by a temperature sensor (thermistor) and determines whether or not it is lower than a predetermined temperature lower than 196° C. which is the adequate temperature. In the illustrative embodiment, the predetermined temperature is 100° C. which is about 50% lower than 196° C. FIG. 9 shows a relation between the duration of the unused state of a photoconductive element and the temperature or fixing temperature of a fixing unit. As FIG. 9 indicates, when the temperature of the fixing unit 14 has lowered to below 100° C. from the adequate temperatue, it may be determined that the belt 5 has been left unused for more than 6 hours and, therefore, has recovered from fatigue. If the temperature of the fixing unit 14 is not lower than 100° C., the CPU 31 enters into an image form mode. If the temperature of interest is lower than 100° C., the CPU 31 starts on the sensor adjust mode. In this mode operation, the CPU 31 inhibits the rotation of the belt 5 and the image forming sequence and, if 4 minutes (necessary for the surface potential sensor 21 to operate stably) has expired after the start of the timer, delivers a sensor adjust command.

Specifically, in the sensor adjust mode, the CPU 31 turns on a relay, not shown, to close the normally open contact a of the relay switch 30. As a result, the Al substrate 5a of the belt 5 is connected to the output of the bias power source 32 and thereby applied with the reference voltage. After storing the resulting output voltage of the surface potential sensor 21 in the RAM, the CPU 31 restores the relay switch 30, i.e., closes the normally closed contact b of the relay switch 30. Consequently, the Al substrate 5a is again connected to ground. In this embodiment, the reference voltage is identical with the target potential for image formation so as to improve the accuracy of potential during image formation. For example, assume that the sensor 21 should be adjusted in the range of −50 V to −1050 V. Then, the CPU 31 controls the bias voltage to −50 V, applies it to the Al substrate 5a, stores the resulting output voltage of the sensor 21 in the RAM, switches the bias voltage to −1050 V, applies it to the Al substrate 5a, and then stores the resulting output of the sensor 21 in the RAM. As a result, the sensor 21 is adjusted over the range of −50 V to 1050 V of the belt potential. The data stored in the RAM is maintained until the power supply to the copier has been turned off.

After the above adjustment, the CPU 31 operates the relay, not shown, to open the normally closed contact to thereby turn off the heater 25, clears the timer to cancel the inhibition of the rotation of the belt 5 and the image forming sequence, and then returns to the main routine.

With the above construction, this embodiment achieves the following various advantages in addition to the advantages of the previous embodiment. Should the belt 5 be rotated during the adjustment of the sensor 21, the surface of the belt 5 would be charged by friction to introduce an error in the resulting output of the surface potential sensor 21. Although the belt 5 may be discharged and illuminated to be prevented from being frictionally charged, such an implementation aggravates the fatigue of the belt 5. In this embodiment, since the belt 5 is inhibited from rotating during the course of adjustment, the change in potential (i.e. reference voltage) ascribable to such frictional charging is eliminated. The embodiment inhibits the image forming sequence from the time when the power source to the copier is turned on to the time when the adjustment of the belt 5 during image formation ends, and inhibits the adjustment of the sensor 21 at least from the time when the sensor 21 is turned on to the time when it becomes stably operable. This further enhances the accurate adjustment of the sensor 21 and, therefore, the accurate measurement of the potential of the belt 5 during image formation, readily implementing the stabilization of an image over a long period of time. In the previous embodiment, since the duration of the unused state of the belt 5 after the turn-off of the power supply to the copier is counted by the timer to determine the recovery time of the belt 5, a battery or similar back-up battery has to be built in the control section. By contrast, this embodiment does not need any back-up battery due to the unique relation between the recovery time of the belt 5 and the duration of the low temperature of the fixing unit found out and since it directly drives the heater 25 by the thermostat. Such advantages make the entire copier simple and inexpensive and, in addition, enhance easy maintenance since the replacement of a power source is not necessary.

In the main routine or body sequence, not shown, whether or not the copier is ready to operate is determined and, if the answer is positive, a copy ON signal is generated. In an image form mode, the belt 5 is brought to a stop at the same position relative to the surface potential sensor 21 at all times every time a copying cycle ends, and the portion of the belt 5 which faces the sensor 21 at the time of stop is constituted by a non-image area. Therefore, although the belt 5 deteriorates due to the image form mode, the sensor 21 senses the area of the belt 21 which has suffered from the same hazards as in the initial stage or from less deterioration due to aging, further promoting accurate adjustment of sensor 21.

Figure 10:
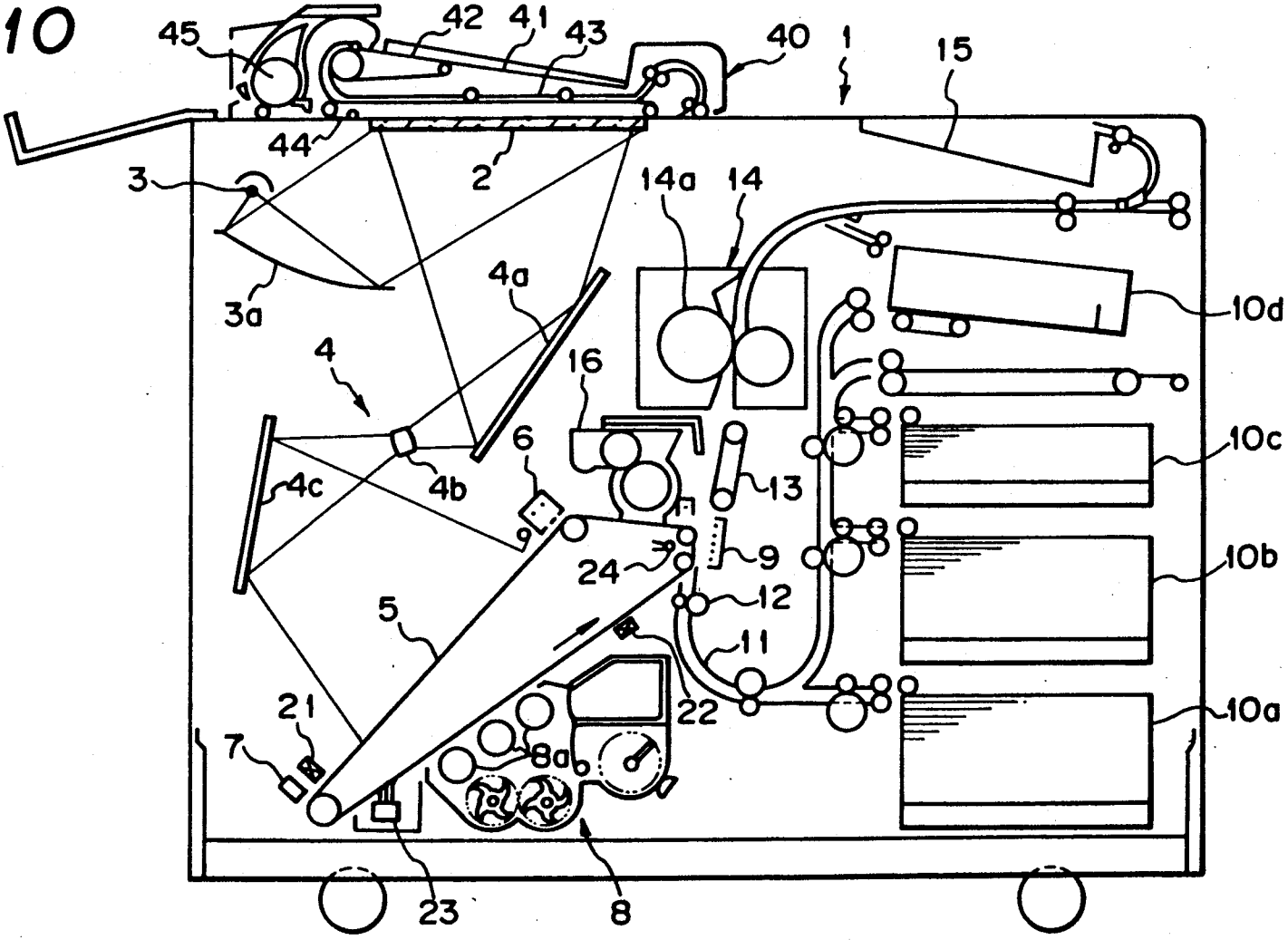
FIG. 10 is a section showing a copier to which another alternative embodiment of the present invention is applicable.
Figure 11:
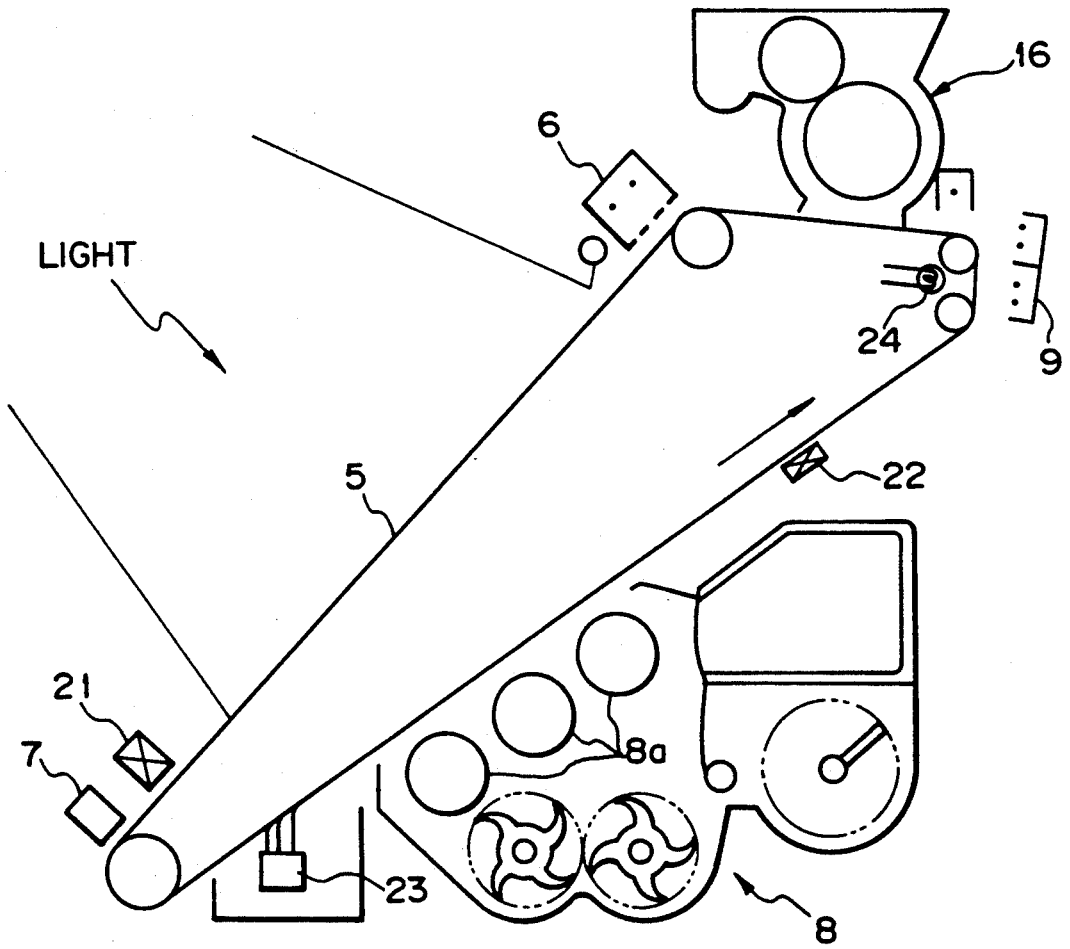
FIG. 11 is a fragmentary enlarged view of the copier shown in FIG. 10.

FIG. 10 shows a copier to which another alternative embodiment of the present invention is applied. FIG. 11 is a fragmentary enlarged view of the copier. Since this embodiment is identical with the embodiment shown in FIGS. 3 and 4 except that it lacks the heater 25, it will not be described specifically to avoid redundancy.

Figure 12:
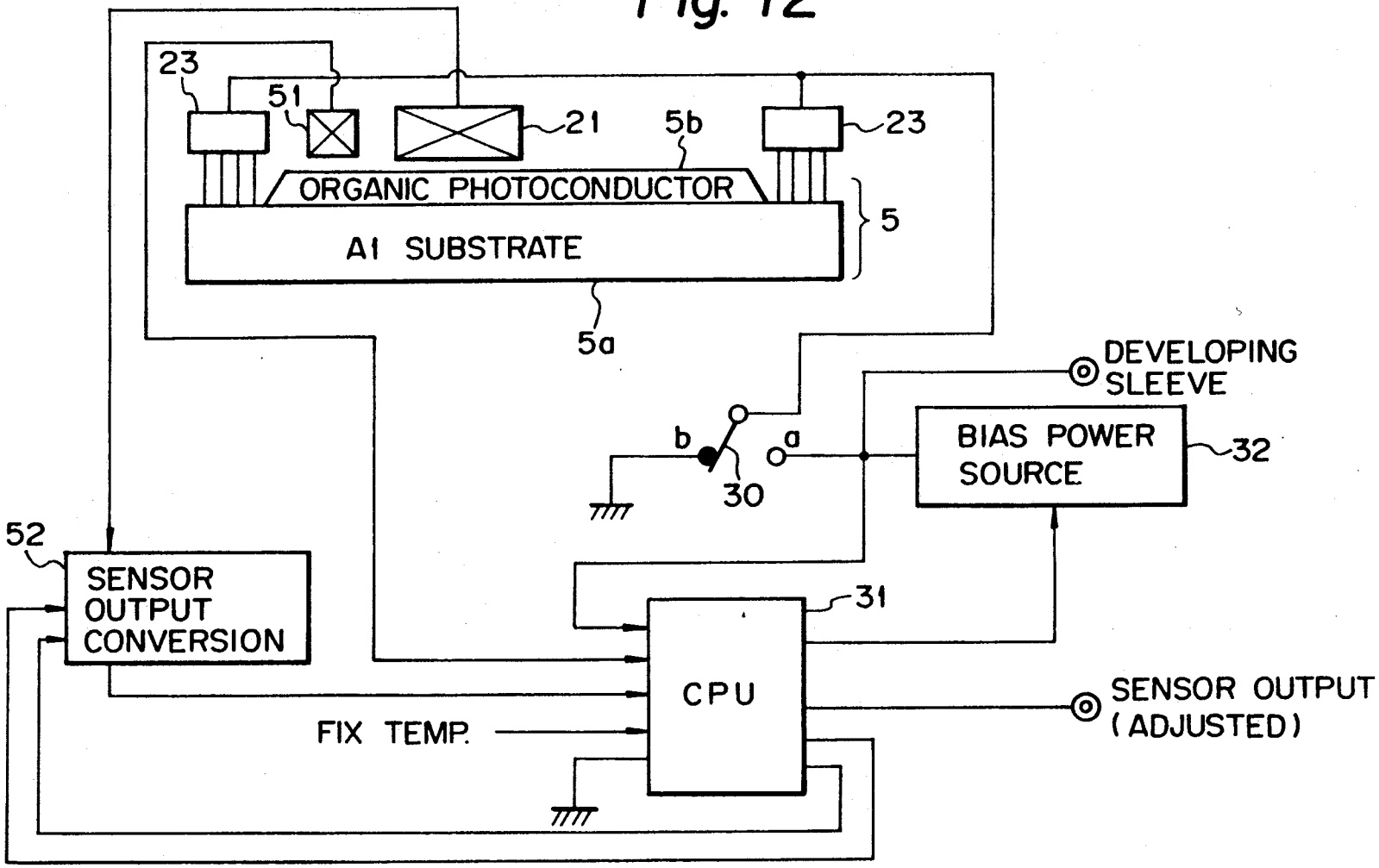
FIG. 12 is a block diagram schematically showing part of a control system associated with the copier of FIG. 10.
Figure 13:
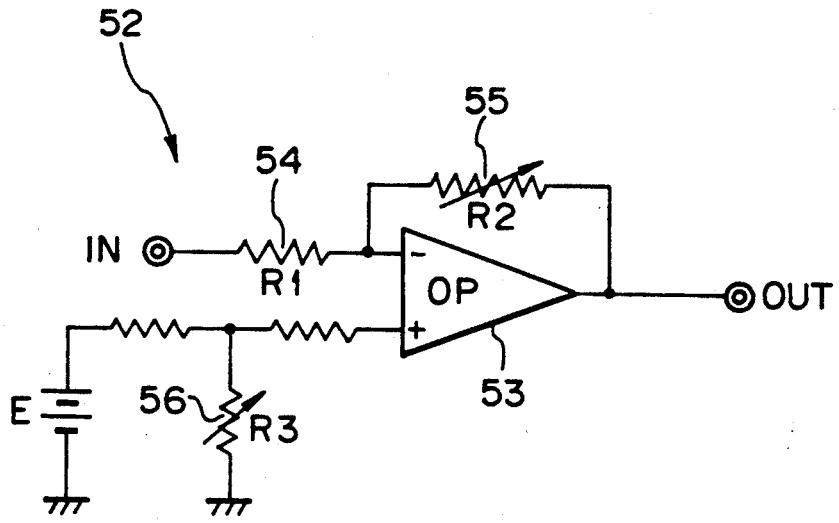
FIG. 13 is a circuit diagram showing a specific construction of a sensor output conversion shown in FIG. 12.

Referring to FIG. 12, part of a control system representative of this embodiment will be described. In the figure, the same components as those shown in FIG. 5 are designated by the same reference numerals. As shown, a temperature sensor (thermistor) 51 is located to face the organic photoconductor 5b of the belt 5 to sense the surface temperature of the belt 5. The output of the temperature sensor 51 is fed to the CPU 31. FIG. 13 shows a specific construction of a sensor output conversion 52 also included in the control system. As shown, the sensor output conversion 52 has an operational amplifier (OP) 53 to which the output of the surface potential sensor 21 is applied via a resistor 54. The OP 53 corrects the input by the resistances of electronic volumes 55 and 56 and then delivers the output thereof to the CPU 31.

Figure 14A:
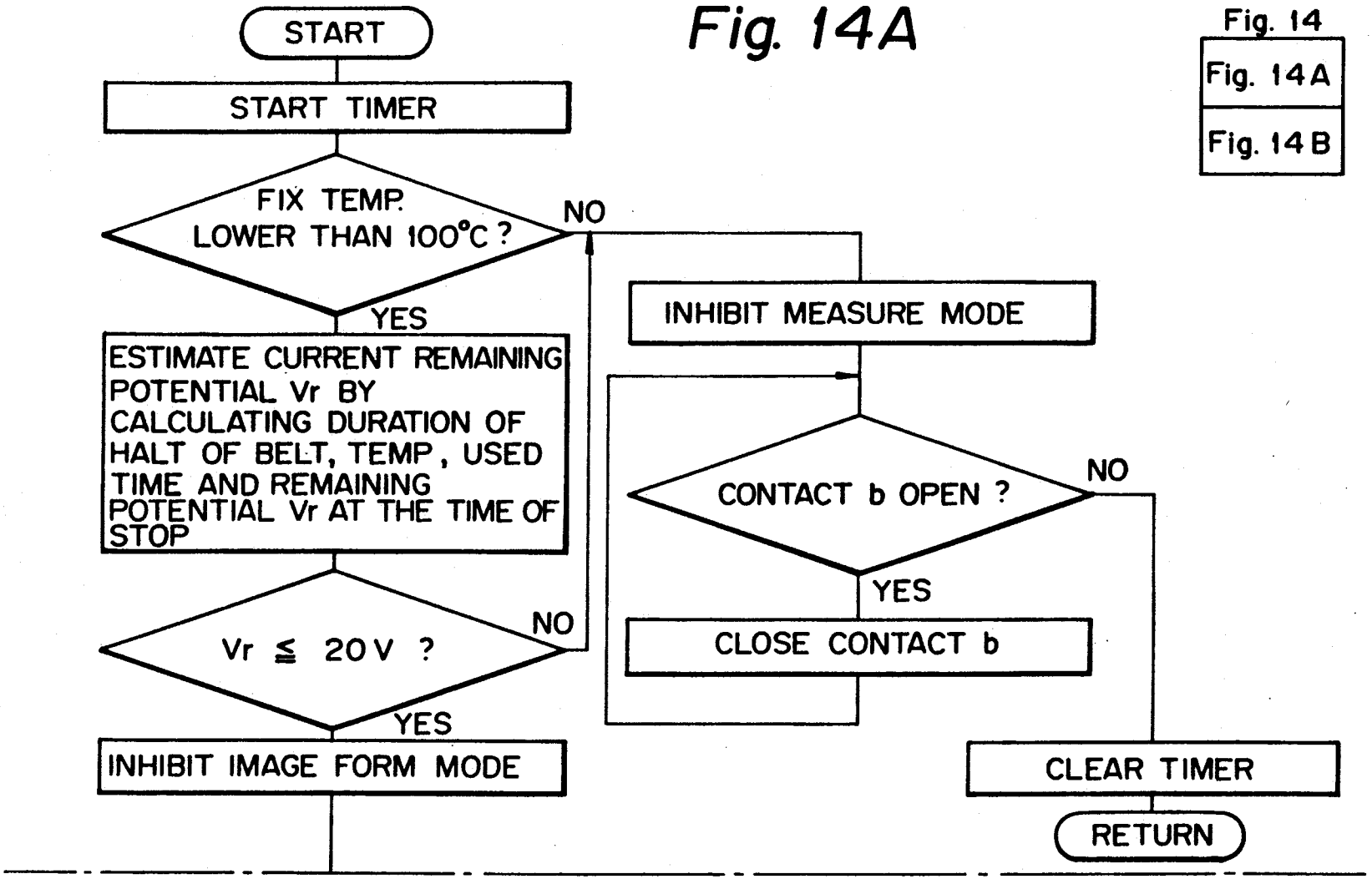
FIG. 14 is a flowchart representative of a specific operation of a CPU shown in FIG. 12.
Figure 14B:
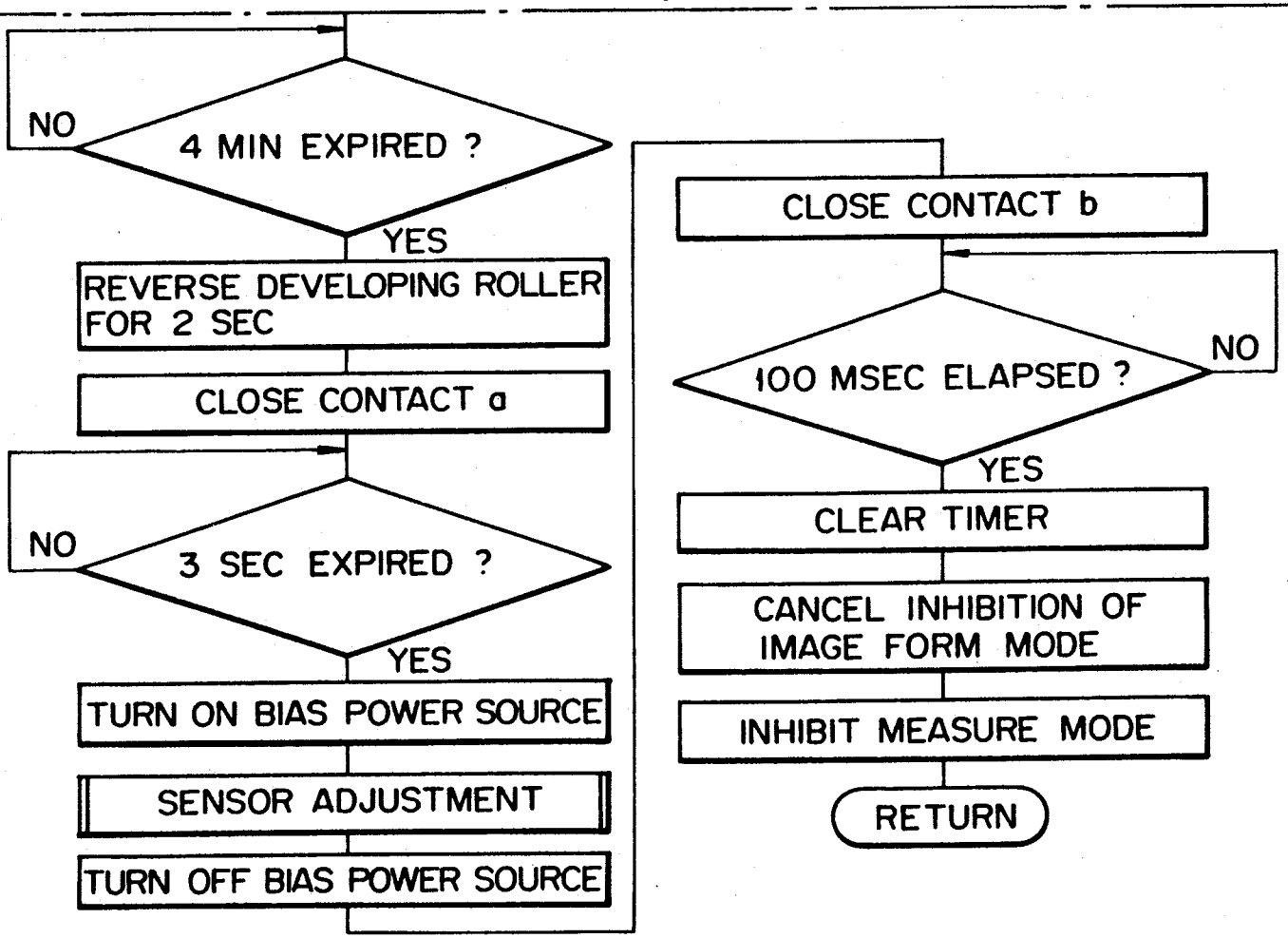

FIG. 14 shows a routine which the CPU 31 of this embodiment executes for adjusting the surface potential sensor 21. On the turn-on of the power supply to the copier, this routine is called from a main routine, not shown. The CPU 31 starts the timer thereof and then determines whether or not the temperature of the fixing unit, i.e., fixing temperature is lower than 100° C. If the fixing temperature is not lower than 100° C., the CPU 31 inhibits the measure mode adapted for the adjustment of the sensor 21 and then determines whether or not the normally closed contact b of the relay switch 30 is open, i.e., whether or not the relay is in an ON state. If the contact b is closed connecting the Al substrate 5a of the belt 5 to ground, the CPU 31 clears the timer and returns to the main routine. If the contact b is open connecting the Al substrate 5a to the output of the bias power source 32, the CPU 31 turns off the relay to close the contact b to thereby connect the substrate 5a to ground. Thereafter, the CPU 31 clears the timer and returns to the main routine. If the fixing temperature is lower than 100° C., the CPU 31 estimates the current remaining potential Vr by determining how long the belt 5 has been left unused, the temperature of the belt 5, how long the belt 5 has been used (proportional to the number of copies produced after the replacement of the belt 5), and the remaining potential Vr at the time when the belt 5 has been stopped. For this purpose, use may be made of ordinary PID control or, if desired, fuzzy control or a neural network which is a recent achievement.

If the estimated remaining potential Vr is not lower than or equal to 20 V, the CPU 31 returns to the main routine after executing the above-stated steps including the inhibition of the measure mode. If the potential Vr is lower than or equal to 20 V, the CPU 31 starts on the measure mode. In this mode, the CPU 31 inhibits the image form mode or copy mode, reverses, on the elapse of 4 minutes necessary for the sensor 21 to operate stably, the developing roller 8a, FIG. 11, for 2 seconds to remove the developer from the roller 8a, and then moves the roller 8a away from the belt 5. Subsequently, the CPU 31 turns on the relay to close the normally open contact a of the relay switch 30 to connect the Al substrate 5a to the output of the bias power source 32. On the elapse of 3 seconds, the CPU 31 turns on the bias power source 32, sets up the sensor adjust mode, and then executes sensor adjustment which will be described with reference to FIGS. 15 and 16. On completing the sensor adjustment, the CPU 31 turns off the bias power source 32 to eliminate contact marks, and then turns off the relay to close the contact b of the relay switch 30. This is the end of the measure mode. On the elapse of 100 microseconds, the CPU 31 clears the timer, cancels the inhibition of the image form mode, inhibits the measure mode, and then returns to the main routine.

Figure 15:
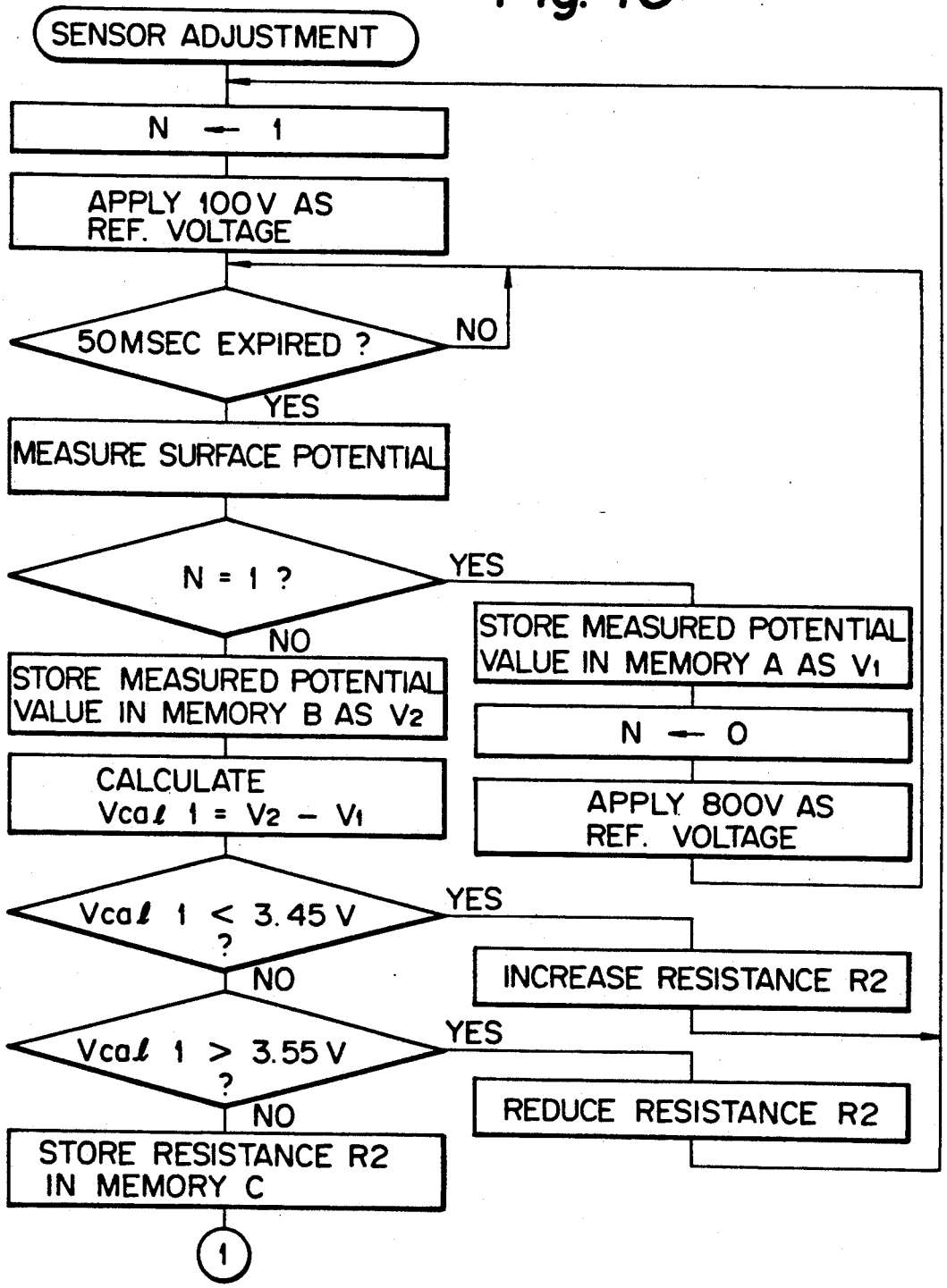
FIGS. 15 and 16 are flowcharts demonstrating a subroutine included in the procedure of FIG. 14.
Figure 16:
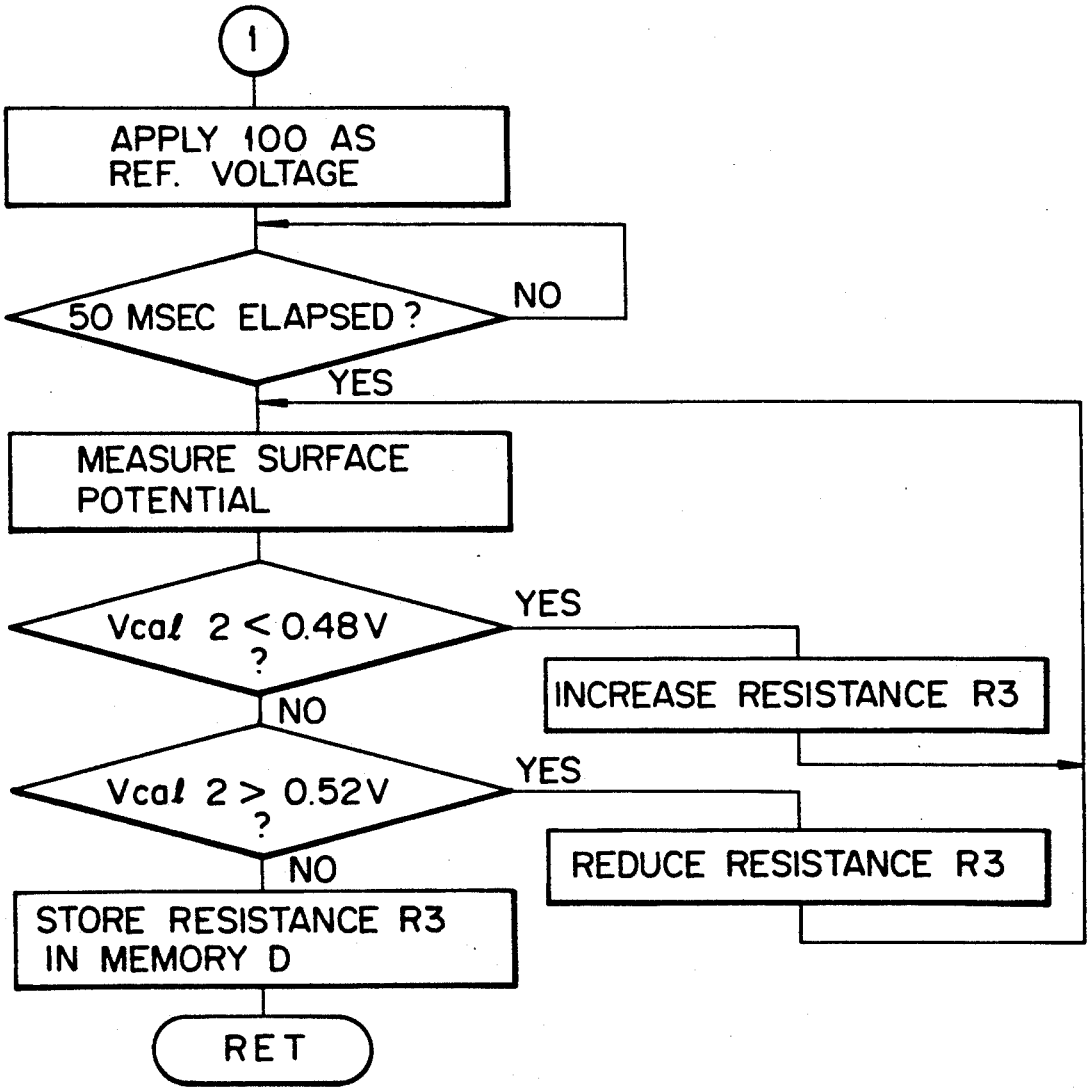

Referring to FIGS. 15 and 16, in the subroutine for sensor adjustment, the CPU 31 sets "1" on the counter thereof, applies a reference voltage of 100 V which is the lower limit of the usable range from the bias power source 32 to the Al substrate 5a, and measures, on the elapse of 50 microseconds necessary for the reference voltage to fully rise, the surface potential of the belt 5 by using the sensor 21 and sensor output conversion 52, FIG. 12. Specifically, the sensor output conversion 52 corrects the output voltage of the sensor 21 and feeds the corrected voltage, which will be referred to as a measured potential value hereinafter, to the CPU 31. Let the output of the sensor 21 be about 1/200 times higher than the input (surface potential of belt 5). Then, the CPU 31 determines whether or not the content N of the counter is "1" . Since "1" has been set on the counter in the first step, the CPU 31 selects a measured potential value V1 matching the voltage of 100 V, stores it in a memory A built therein, and then clears the counter. Thereafter, the CPU 31 applies a reference voltage of 800 V which is the upper limit of the usable range from the bias power source 32 to the Al substrate 5a, and measures, on the lapse of 50 microseconds, the surface potential of the belt 5 by using the sensor 21 and sensor output conversion 52.

The CPU 31 again determines whether or not the content N of the counter is "1". Since the content N is "0", the CPU 31 selects a measured potential value V2 matching the voltage of 800 V, stores it in a memory B also built therein, and then calculates Vcal 1=V2−V1. Assume that the allowable range of of the surface potential of the belt 5 obtained from the measured potential value on the application of a voltage to the L substrate 5a is the actual surface potential ±10 V. Then, Vcal 1 will normally range from 3.5±0.05 V. The CPU 31, therefore, determines whether or not the calculated Vcal 1 lies in the normal range of 3.5±0.05 V and, if the answer is negative, changes the resistance R2 of the electronic volume 55, FIG. 13, to confine it in such a range. Specifically, if Vcal 1 is lower than 3.45 V, the CPU 31 increases the resistance R2 of the volume 55 by a predetermined value; if it is higher than 3.55 V, the CPU 31 reduces the resistance R2 by a predetermined value. Subsequently, the CPU 31 returns to the first step to repeat the above procedure. When Vcal 1 is brought into the range of 3.5±0.05 V, i.e., when the line interconnecting the measured potential values associated with 800 V and 100 V obtains a predetermined gradient, the CPU 31 stores the resistance R2 of the volume 55 in a memory C built therein.

Subsequently, as shown in FIG. 16, the CPU 31 again applies 100 V to the Al substrate 5a and, on the lapse of 50 microseconds, measures the surface potential of the belt 5 by using the sensor 21 and sensor output conversion 52. Assuming the measured potential value is Vcal 2, the CPU 31 determines whether or not Vcal 2 lies in a normal range of 0.5±0.02 V and, if the answer is negative, changes the resistance R3 of the electronic volume 56, FIG. 13, to confine it in such a range. Specifically, if Vcal 2 is lower than 0.48 V, the CPU 31 increases the resistance R3 by a predetermined value; if it is higher than 0.52 V, the CPU 31 reduces the resistance R3 by a predetermined value. Thereafter, the CPU 31 repeats the above procedure until Vcal enters the range of 0.5±0.02 V. Then, the CPU 31 stores the resistance R3 of the volume 56 in a memory D thereof and returns to the routine shown in FIG. 14. It is to be noted that 100 V applied to the Al substrate 5a in the event of adjustment of the volume 56 as stated above is to enhance the accuracy of low voltages in the usable range. Considering the entire usable range, however, it is preferable to select the center value, i.e., (800−100)/2=350 V.

This embodiment is comparable with the previous embodiments regarding advantages and, moreover, achieves the following additional advantages. Since the developing roller 8a is reversed to remove the toner before the adjustment of the sensor 21 and then moved away from the belt 5, the leakage of voltage is eliminated and, therefore, an accurate reference voltage can be applied to the Al substrate 5a of the belt 5. Although the gap between the belt 5 and the sensor 21 and the sensitivity of the sensor 21 may differ from one copier to another, accurate sensor adjustment is further promoted since the measured potential value associated with a reference value applied to the Al substrate 5a is maintained constant. Further, the degree of recovery of the belt 5 is minutely estimated, enhancing accurate decision on the time for adjusting the sensor 21.

While the foregoing description has concentrated on a full surface exposure type electrophotographic copier using a photoconductive element in the form of a belt, the present invention is, of course, applicable to a scan exposure type electrophotographic copier using a photoconductive drum or even to a laser printer, facsimile transceiver or similar image forming apparatus.

In summary, in accordance with the present invention, a photoconductive element is used as a reference plate while a surface potential sensor is fixed in place. The surface potential sensor is adjusted on the basis of a reference value which is the surface potential of the photoconductive element developed while an image is not formed. This not only reduces the cost due to the absence of a conventional reference plate but also eliminates the need for special operations for adjustment. Moreover, since the relative surface potential of the photoconductive element is detected with high accuracy, the image quality remains stable. The present invention is practicable with an inexpensive surface potential sensor which has distance dependency and, therefore, applicable even to inexpensive image forming apparatuses.

Various modifications will become possible for those skilled in the art after receiving the teachings of the present disclosure without departing from the scope thereof.

What is claimed is:

1. A method of adjusting a surface potential sensor for measuring a surface potential of a surface of a photoconductive element included in an image forming apparatus, said method comprising the steps of:

(a) leaving said photoconductive element unused for a period of time necessary for said photoconductive element to recover from fatigue;

(b) applying a reference voltage to a substrate included in said photoconductive element; and (c) adjusting said surface potential sensor by using, as a reference value, a resulting potential generated on the surface of said photoconductive element as a result of the application of said reference voltage to said substrate included in said photoconductive element.

2. A method as claimed in claim 1, wherein step (a) comprises (d) maintaining said photoconductive element at a temperature having been measured during image formation while said photoconductive element is left unused.

3. A method as claimed in claim 1, wherein step (c) comprises (d) holding said photoconductive element in a halt state when said surface potential sensor is being adjusted.

4. A method as claimed in claim 1, wherein said substrate of said photoconductive element is usually connected to ground and is connected to a bias power source for development during an adjustment of said surface potential sensor.

5. A method as claimed in claim 1, wherein step (a) comprises (d) determining the time when said photoconductive element recovers from fatigue on the basis of the period of time for which said photoconductive element has been left unused.

6. A method as claimed in claim 1, wherein step (a) comprises (d) determining a time when said photoconductive element recovers from fatigue based on a temperature of a fixing unit after a power supply to said image forming apparatus has been turned on.

7. A method as claimed in claim 6, wherein step (d) comprises (e) determining that, when said fixing unit reaches a predetermined temperature lower than the temperature measured during image formation, said photoconductive element has recovered from fatigue.

8. A method as claimed in claim 1, wherein said image forming apparatus is inhibited from forming an image from a first time when power supply to said image forming apparatus is turned on to a second time when the step of adjusting said surface potential sensor is completed.

9. A method as claimed in claim 1, further comprising a step (d) of moving a developing roller away from said photoconductive element before adjusting said surface potential sensor.

10. A method as claimed in claim 1, wherein the step of adjusting said surface potential sensor is inhibited at least from a first time when power supply to said surface potential sensor is turned on to a second time when said surface potential sensor becomes stably operable.

11. A method as claimed in claim 1, wherein step (c) comprises (d) adjusting said surface potential sensor such that a measured value produced by said surface potential sensor in response to said reference voltage is constant.

* * * * *

UNITED STATES PATENT AND TRADEMARK OFFICE

CERTIFICATE OF CORRECTION

PATENT NO. : 5,200,780

DATED : April 6, 1993

INVENTOR(S) : Yasushi Koichi

It is certified that error appears in the above-identified patent and that said Letters Patent is hereby corrected as shown below:

On the title page, Item [75],

The inventor's name is incorrect, should be, --Yasushi Koichi--

Signed and Sealed this

Twenty-third Day of November, 1993

*Attest:*

*Attesting Officer*

Bruce Lehman

BRUCE LEHMAN

*Commissioner of Patents and Trademarks*